US006938452B2

(12) United States Patent
Rudolph et al.

(10) Patent No.: US 6,938,452 B2
(45) Date of Patent: Sep. 6, 2005

(54) METHOD AND APPARATUS FOR FASTENING STEEL FRAMING BY CRIMPING

(75) Inventors: Scott Rudolph, Cockeysville, MD (US); Robert Gehret, Hampstead, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/765,764

(22) Filed: Jan. 26, 2004

(65) Prior Publication Data

US 2004/0154154 A1 Aug. 12, 2004

Related U.S. Application Data

(62) Division of application No. 10/177,881, filed on Jun. 21, 2002, now Pat. No. 6,705,14.7

(60) Provisional application No. 60/299,904, filed on Jun. 21, 2001, provisional application No. 60/299,901, filed on Jun. 21, 2001, and provisional application No. 60/299,943, filed on Jun. 21, 2001.

(51) Int. Cl.[7] ..... B21D 31/02

(52) U.S. Cl. ..... 72/325; 72/409.01; 72/409.11; 29/432.1; 403/283

(58) Field of Search ..... 72/325, 409.01, 72/409.11, 409.17, 409.18, 416, 453.15, 453.16; 29/432.1, 243.5, 243.57, 243.58; 403/283

(56) References Cited

U.S. PATENT DOCUMENTS

| | | | |
|---|---|---|---|
| 1,444,618 | A | 2/1923 | Levingston |
| 1,912,222 | A | 5/1933 | Heyman |

(Continued)

FOREIGN PATENT DOCUMENTS

| | | | |
|---|---|---|---|
| DE | 155 135 | C | 10/1904 |
| DE | 308 681 | C | 10/1918 |
| DE | 369 395 | C | 2/1923 |
| DE | 2557845 | A1 | 6/1977 |
| DE | 31 47 430 | A | 6/1983 |
| DE | 199 34 998 | A | 2/2001 |
| FR | 2 595 609 | | 9/1987 |
| FR | 2651283 | | 8/1989 |
| FR | 2745863 | | 3/1996 |
| GB | 608 373 | A | 9/1948 |
| GB | 2306366 | A | 5/1997 |
| JP | 59 185529 | A | 10/1984 |
| WO | WO 92 03664 | A | 3/1992 |
| WO | WO 01 38746 | A | 5/2001 |
| WO | WO 01 65125 | A | 9/2001 |
| WO | WO 03/001075 | | 1/2003 |

OTHER PUBLICATIONS

International Search Report for PCT/US02/19536 mailed Sep. 5, 2002.
International Search Report for PCT/US02/19626 mailed Sep. 18, 2002.

(Continued)

*Primary Examiner*—Ed Tolan

(74) *Attorney, Agent, or Firm*—Harness, Dickey & Pierce, P.L.C.

(57) ABSTRACT

A punch having wings is driven through framing members and then rotated. Rotation of the punch causes the wings to crimp the framing members together. An angular crimping technique where piercing members are driven through framing members in at least two different directions to crimp the framing members together. A fastenerless cinching tool pierces adjacent framing member and crimps the framing members together.

18 Claims, 15 Drawing Sheets

U.S. PATENT DOCUMENTS 2,006,813 A 7/1935 Norwood
2,178,187 A 10/1939 Sake
2,410,047 A 10/1946 Burrows et al.
2,429,239 A 10/1947 Rogers
2,800,960 A * 7/1957 Cutler ..... 29/566
2,944,262 A 7/1960 Richman et al.
2,994,243 A 8/1961 Langstroth
3,322,017 A 5/1967 Dufficy
3,332,311 A 7/1967 Schulz
3,714,688 A * 2/1973 Olson ..... 29/21.1
3,722,280 A 3/1973 Van Greuingen
3,882,755 A 5/1975 Enstrom
3,925,875 A 12/1975 Doke
3,999,352 A * 12/1976 Doke ..... 52/690
4,025,029 A 5/1977 Kotas et al.
4,183,239 A 1/1980 Stubbings
4,218,953 A 8/1980 Haytayan
4,247,219 A 1/1981 Ausprung
4,402,641 A 9/1983 Arff
4,511,296 A 4/1985 Stol
4,601,625 A 7/1986 Ernst et al.
4,708,552 A 11/1987 Bustos et al.
4,787,795 A 11/1988 Kraus
4,810,150 A 3/1989 Matsukane et al.
4,840,523 A 6/1989 Oshida
4,902,182 A 2/1990 Lewis
5,030,051 A 7/1991 Kaneko et al.
5,207,750 A 5/1993 Rapata
5,240,361 A 8/1993 Armstrong et al.
5,253,965 A 10/1993 Angel
5,259,689 A 11/1993 Arand et al.
5,323,632 A 6/1994 Shirasaka et al.
5,333,483 A * 8/1994 Smith ..... 72/325
5,375,957 A 12/1994 Golledge
5,376,097 A 12/1994 Phillips
5,460,317 A 10/1995 Thomas et al.
5,567,101 A 10/1996 Martin
5,658,110 A 8/1997 Kraus
5,718,142 A 2/1998 Ferraro
5,775,860 A 7/1998 Meyer
5,794,835 A 8/1998 Colligan et al.
5,829,664 A 11/1998 Spinella et al.
5,829,817 A 11/1998 Ge
5,855,099 A 1/1999 Hoffman
5,937,690 A * 8/1999 Pomerleau ..... 72/325
5,975,406 A 11/1999 Mahoney et al.
6,023,898 A 2/2000 Josey
6,045,028 A 4/2000 Martin et al.
6,067,839 A 5/2000 Xie
6,095,395 A 8/2000 Fix, Jr.
6,102,636 A 8/2000 Geise
6,168,066 B1 1/2001 Arbegast
6,206,268 B1 3/2001 Mahoney
6,273,656 B1 8/2001 Cleland et al.
6,276,644 B1 8/2001 Jennings et al.
6,354,683 B1 3/2002 Benbow
6,398,883 B1 6/2002 Forrest et al.
6,662,620 B1 * 12/2003 Baron et al. ..... 72/452.4
6,705,147 B2 3/2004 Judge
6,719,512 B2 4/2004 Berry et al.
2002/0014516 A1 2/2002 Nelson et al.
2002/0027156 A1 3/2002 Coletta et al.
2002/0062551 A1 * 5/2002 Jacoby ..... 29/798
2002/0071741 A1 6/2002 Oswald
2002/0125297 A1 9/2002 Stol et al.
2003/0010805 A1 1/2003 Nelson
2003/0012620 A1 1/2003 O'Banion et al.
2003/0116609 A1 6/2003 Dracup et al.

OTHER PUBLICATIONS

International Search Report for PCT/US02/19627 mailed Sep. 16, 2002.
International Search Report for PCT/US02/19727 mailed Sep. 16, 2002.
International Search Report for PCT/US02/19757 mailed Feb. 18, 2003.
International Search Report for PCT/US02/20063 mailed Jan. 29, 2003.

* cited by examiner

Figure - 16
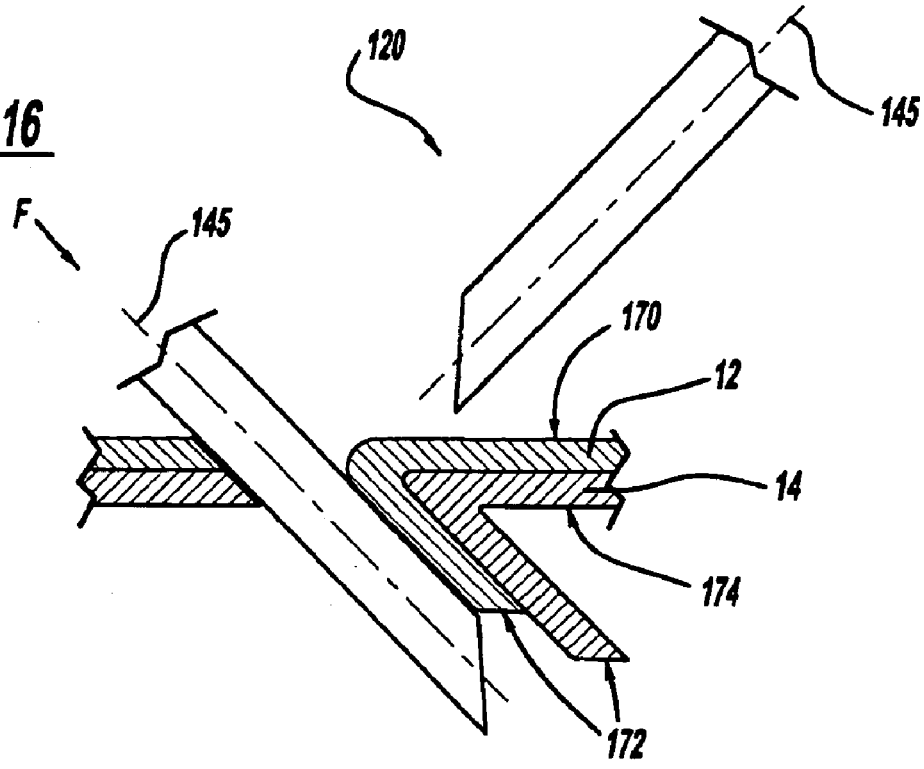
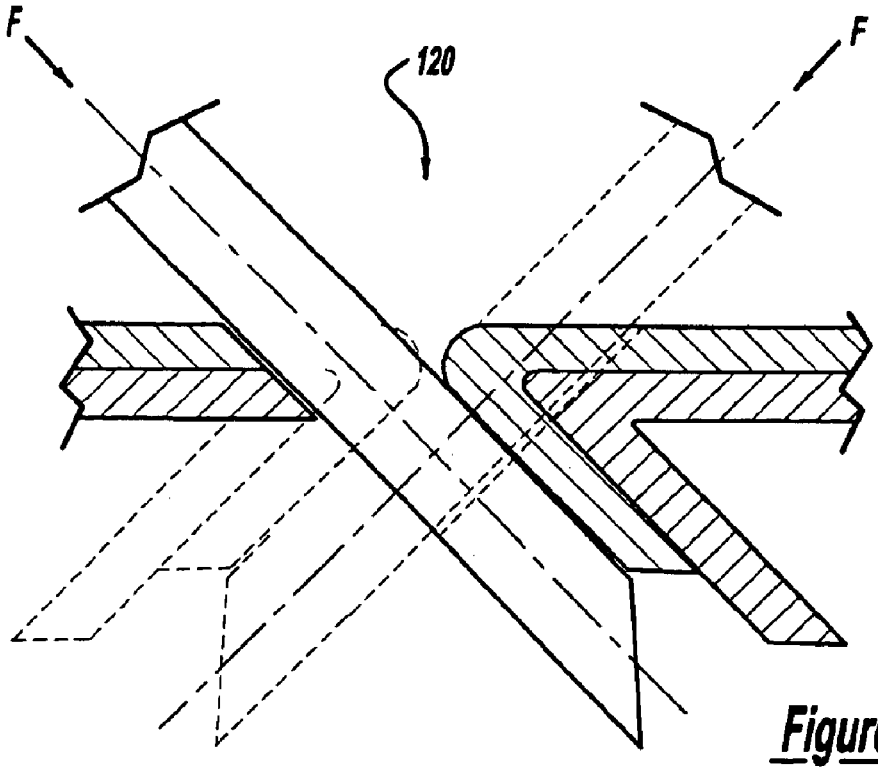
Figure - 17

METHOD AND APPARATUS FOR FASTENING STEEL FRAMING BY CRIMPING

CROSS-REFERENCE TO RELATED APPLICATIONS

This application is a divisional of U.S. application Ser. No. 10/177,881, now U.S. Pat. No. 6,705,147, filed Jun. 21, 2002, which claims the benefit of U.S. Provisional Application Nos. 60/299,904, filed Jun. 21, 2001, 60/299,901, filed Jun. 21, 2001, and 60/299,943, filed Jun. 21, 2001.

FIELD OF THE INVENTION

The present invention relates generally to steel framing and, more particularly, to an improved cost-effective method for fastening steel framing.

BACKGROUND OF THE INVENTION

Steel framing is revolutionizing the construction industry. Steel is a high quality framing material that will not shrink, warp, or attract termites and other wood boring insects. In recent years, the price of steel has become more competitive with wood and other construction materials. However, despite its advantages, steel framing has not become prevalent in the residential construction industry. The lack of a quick and cost effective technique for fastening steel members has prevented steel framing from emerging as the predominant building material in residential construction.

Therefore, it is desirable to provide a quick and cost-effective technique for fastening steel members. It is envisioned that the steel fastening technique will be comparable in speed to an air nailer used to fasten wood materials. It is further envisioned that the steel fastening technique will provide a minimal gap between steel members, a pullout force of at least 216 lb., a shear force of at least 164 lb., as well as cause minimal destruction of any galvanize coating on the steel members.

SUMMARY OF THE INVENTION

The present invention discloses various tools and techniques for fastening framing members by crimping the framing members together.

In a first aspect in accordance with the present invention, a punch having wings is disclosed. The punch is driven through framing members and then rotated. Rotation of the punch causes the wings to crimp the framing members together.

In a second aspect in accordance with the present invention, an angular crimping technique and piercing member to perform the technique are disclosed. Piercing members are driven through adjacent framing members in at least two different directions to crimp the framing members together.

In a third aspect in accordance with the present invention, a fastenerless cinching tool is disclosed. The tool pierces adjacent framing members and crimps the framing members together.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 16 is a cross-sectional view, taken along line 15—15 of FIG. 1, illustrating a first piercing member driven through the two steel framing members in accordance with the present invention;

FIG. 17 is a cross-sectional view, taken along line 15—15 of FIG. 14, illustrating a second piercing member in relation to the first piercing member that was driven through the two steel framing members in accordance with the present invention;

DETAILED DESCRIPTION OF THE PREFERRED EMBODIMENTS

The following description of the preferred embodiment(s) is merely exemplary in nature and is in no way intended to limit the invention, its application, or uses.

Figure 1:
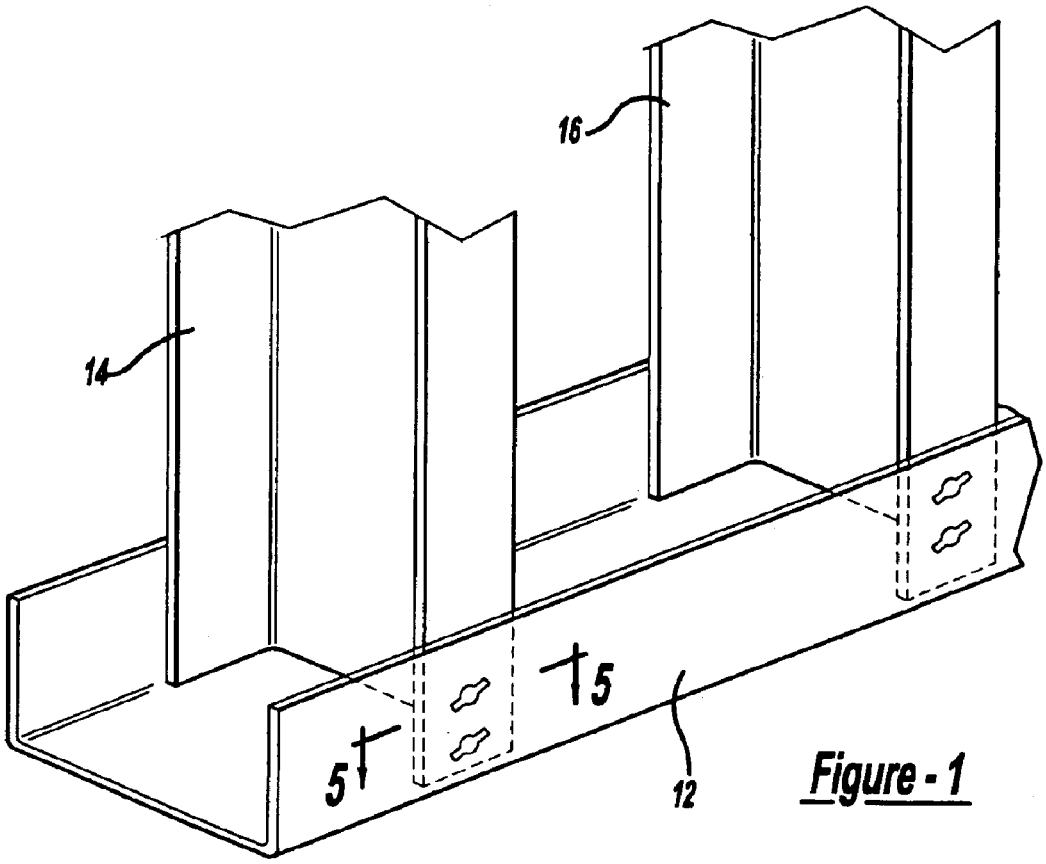
FIG. 1 is a fragmentary perspective view of a steel framing member having two additional steel framing members fastened thereto by a rotatable punch in accordance with the present invention.
Figure 2:
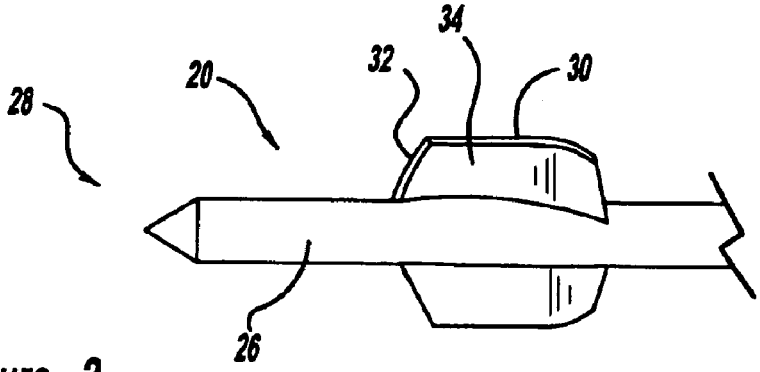
FIG. 2 is a side view of a first preferred embodiment of a rotatable punch in accordance with the present invention.

Referring to FIG. 1, a fragmentary perspective view of a longitudinal steel framing member 12 having two upright steel framing members 14 and 16 fastened thereto. Each C-shaped framing member includes a bottom wall and two side walls having a thickness in the range from 0.018" to 0.071". Additionally, each framing member may range from 33 ksi to 80 ksi as is well known in the art. As will be more fully described below, one or more fasteners 20 may be used to join the upright framing members 14 and 16 to the longitudinal framing member 12. While the following description is provided with reference to this particular configuration, it is readily understood that the fastening technique of the present invention is applicable to any two or more adjacent members made of steel or other material having similar attributes to those of steel.

In a first aspect in accordance with the present invention, a rotatable punching technique is used to join steel framing members together. A first preferred embodiment of a rotatable punch 20 is depicted in FIGS. 2–7. Punch 20 has a first end 22 and an axially opposite second end (not shown). A stem 26 extends axially between first end 22 and the second end. Stem 26 has a tip 28 proximate first end 22. Tip 28 is configured to pierce and penetrate through steel framing members in response to a driving force F applied to punch 20, as will be described in more detail below.

Figure 3:
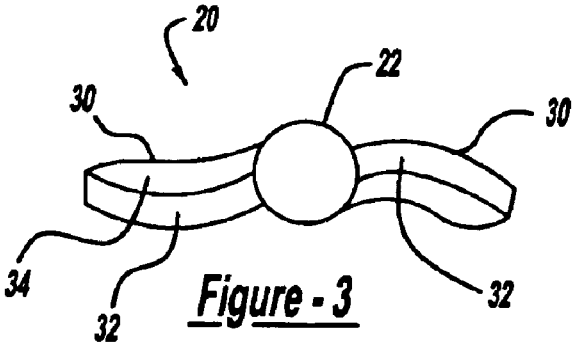
FIG. 3 is a bottom view of the first preferred embodiment of the rotatable punch in accordance with the present invention.
Figure 4:
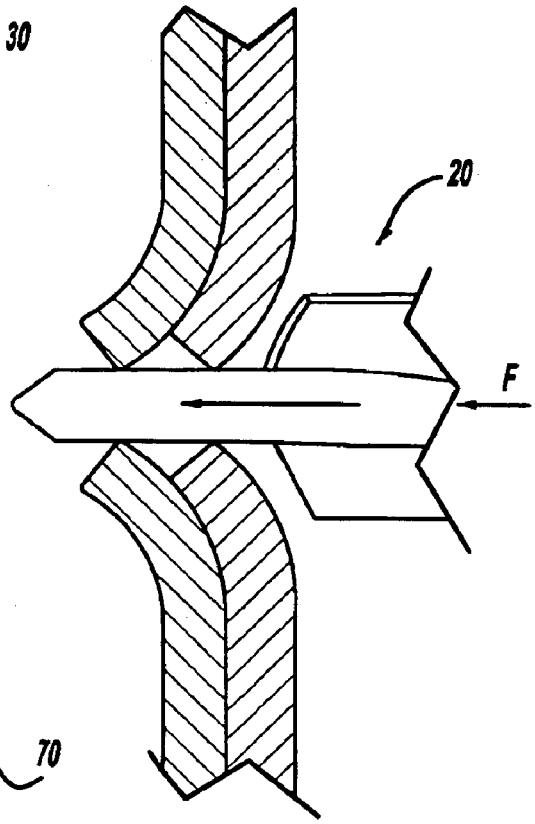
FIGS. 4 and 5 are cross-sectional views, taken along line 5—5 of FIG. 1, illustrating the first preferred embodiment of the rotatable punch piercing through two steel framing members.

A pair of wings 30 extend along a portion of a length of stem 26. Wings 30 have a leading edge 32 that is configured to pierce and penetrate through steel framing members in response to driving force F applied to punch 20 as will be described in more detail below. Each wing 30 has an engaging surface 34 that engages with steel framing members and causes them to deform when punch 20 is rotated, as will be described in more detail below. Wings 30 are curved to facilitate the deforming of steel framing members with punch 20. As can be seen, wings 30 and engaging surfaces 34 curve as wings 30 extend along stem 26. Additionally, wings 30 and engaging surfaces 34 also curve as wings 30 extend radially outwardly from stem 26. Curvature of wings 30 and engaging surfaces 34 advantageously provide desirable deformation of framing members in response to rotation of punch 20. Preferably, wings 30 are spaced evenly about a periphery of stem 26, as shown in FIG. 3.

Figure 5:
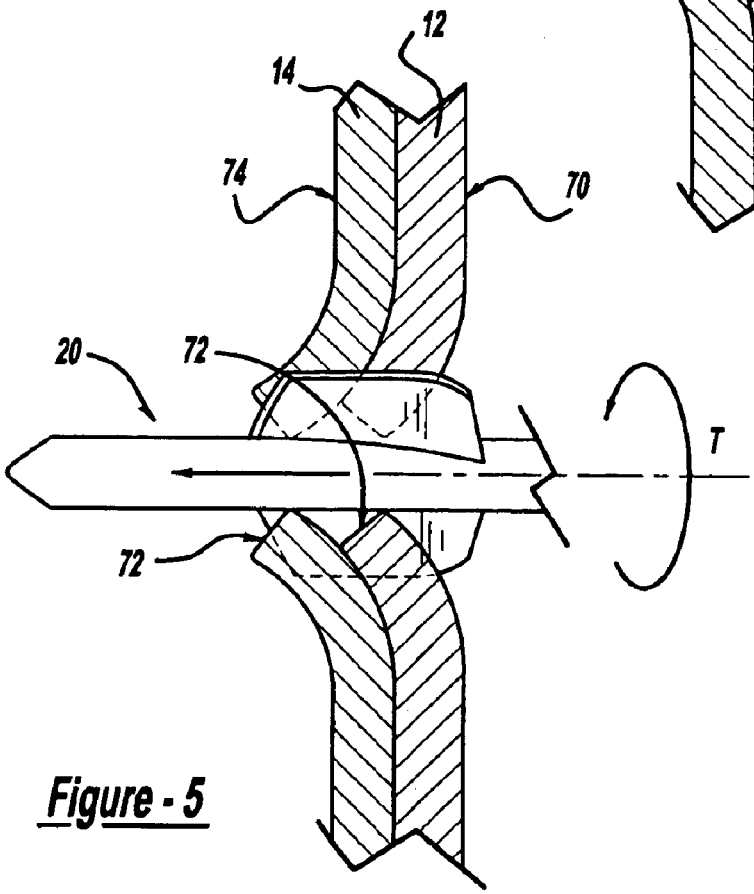

Punch 20 is used to deform steel framing members relative to one another to crimp the steel framing members together. To accomplish the crimping process, tip 28 is positioned adjacent a top surface 70 of two or more steel framing members, such as 12 and 14. Driving force F is applied to punch 20 which causes tip 28 and stem 26 to pierce and penetrate through framing members 12 and 14. Driving force F is applied to punch 20 until wings 30, as shown in FIG. 5, extend through the opening in framing members 12 and 14 caused by stem 26. Leading edges 32 of wings 30 engage with top surface 70 of framing member 12 and then inner surfaces 72 of framing members 12 and 14 when penetrating through framing members 12 and 14. Leading edge 32 is configured to facilitate the penetration of wings 30 so that the magnitude of the driving force F required to pierce and penetrate through framing members 12 and 14 is minimized. The curved nature of the engaging surfaces 34 of wings 30 cause the framing members 12 and 14 to begin to deform as wings 30 penetrate through framing members 12 and 14.

Figure 6:
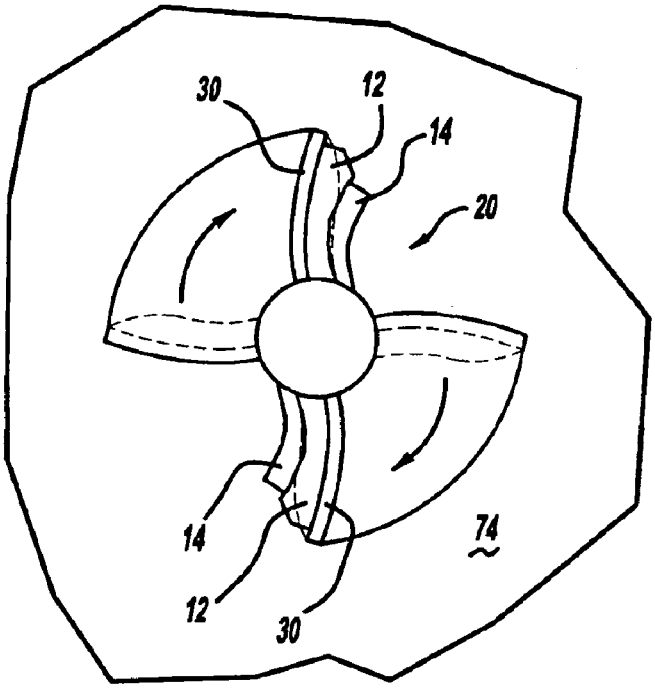
FIGS. 6 and 7 are bottom views illustrating the rotation of the first preferred embodiment of the rotatable punch in the steel framing members in accordance with the present invention.
Figure 7:
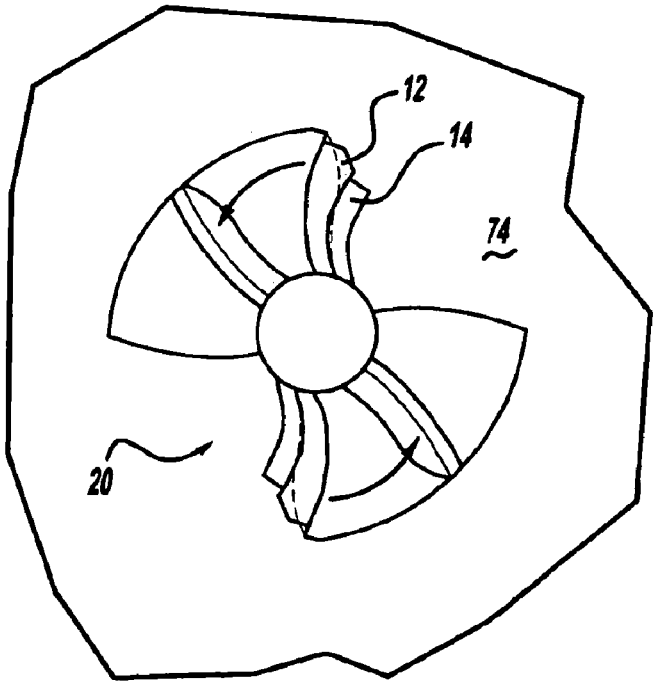
Figure 8:
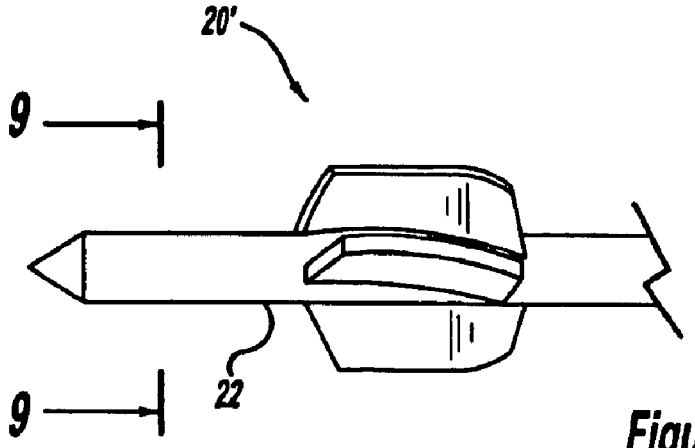
FIG. 8 is a side view of a second preferred embodiment of a rotatable punch in accordance with the present invention.

When wings 30 extend completely through both framing members 12 and 14 and engaging surfaces 34 are engaged with framing members 12 and 14, driving force F is no longer applied. Punch 20, as shown in FIG. 6, is then rotated by rotational torque T in a first direction so that engaging surfaces 34 on wings 30 engage with inner surfaces 72 of framing members 12 and 14. The rotation causes engaging surfaces 34 to deform inner surfaces 72 which bend over each other and crimp together. After punch 20 has been rotated a number of degrees sufficient to cause framing members 12 and 14 to crimp together, punch 20 is then rotated in a second direction opposite the first direction until punch 20 is proximately in its original orientation before initial rotation began. Punch 20 is then removed from between framing members 12 and 14.

Punch 20 can be rotated a varying number of degrees to crimp framing members 12 and 14 together. Preferably, punch 20 is rotated in the range of about 45–135 degrees. However, it should be understood that it may be possible to obtain satisfactory crimping of framing members 12 and 14 together by rotating punch 20 through other degrees of rotation that provide a sufficient crimp between framing members 12 and 14 so as to fasten the framing members together and meet the above stated requirements.

Figure 9:
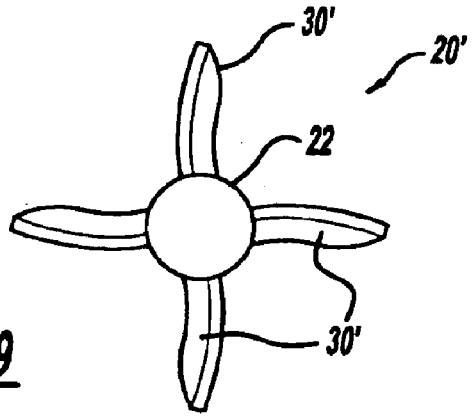
FIG. 9 is a bottom view of the second preferred embodiment of the rotatable punch in accordance with the present invention.
Figure 10:
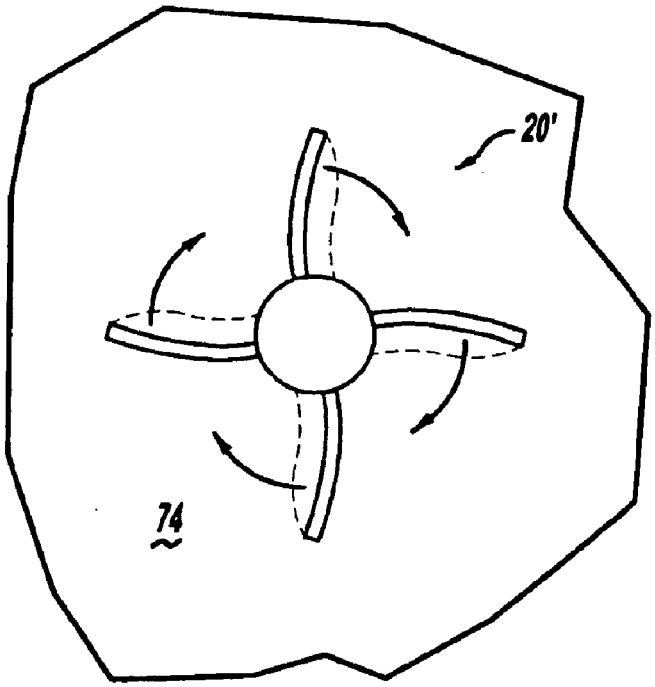
FIGS. 10 and 11 are bottom views illustrating the rotation of the second preferred embodiment of the rotatable punch in the steel framing members in accordance with the present invention.
Figure 11:
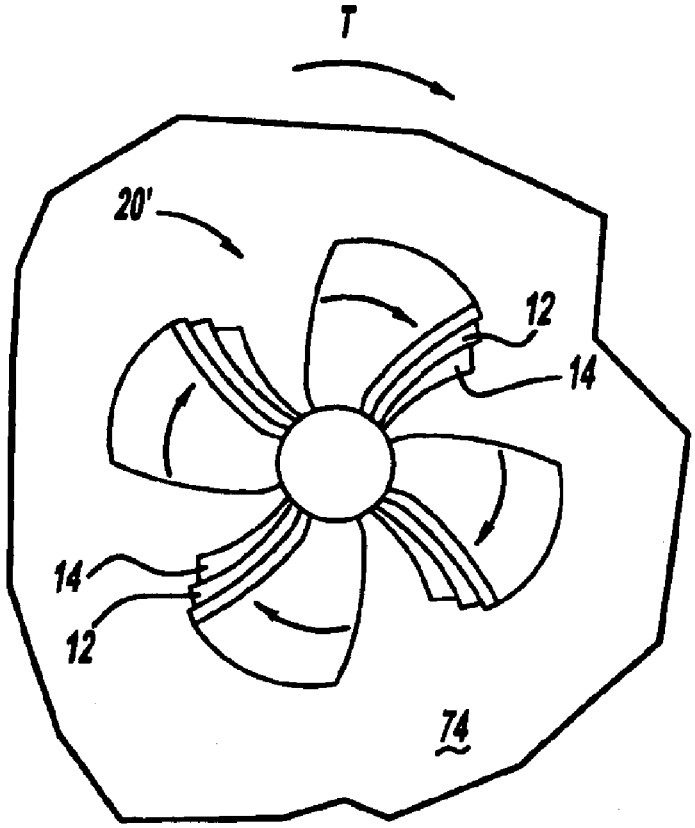

Referring now to FIGS. 8–11, a second preferred embodiment of punch 20' is shown. Punch 20' is substantially identical to punch 20 with the addition of a second pair of wings 30'. As can be seen in FIG. 9, wings 30' are spaced evenly about a periphery of stem 26. When using punch 20' to crimp framing members 12 and 14 together, as can best be seen in FIG. 11, punch 20' can be rotated through a lesser number of degrees than punch 20 due to the additional wings 30'. Preferably, punch 20' is rotated in a range of about 25–60 degrees. Additionally, the use of four wings 30' provide four separate crimping joints between framing members 12 and 14. As will be apparent to one skilled in the art, stem 26 can have more than four wings 30' and be within the scope of the present invention.

Figure 13:
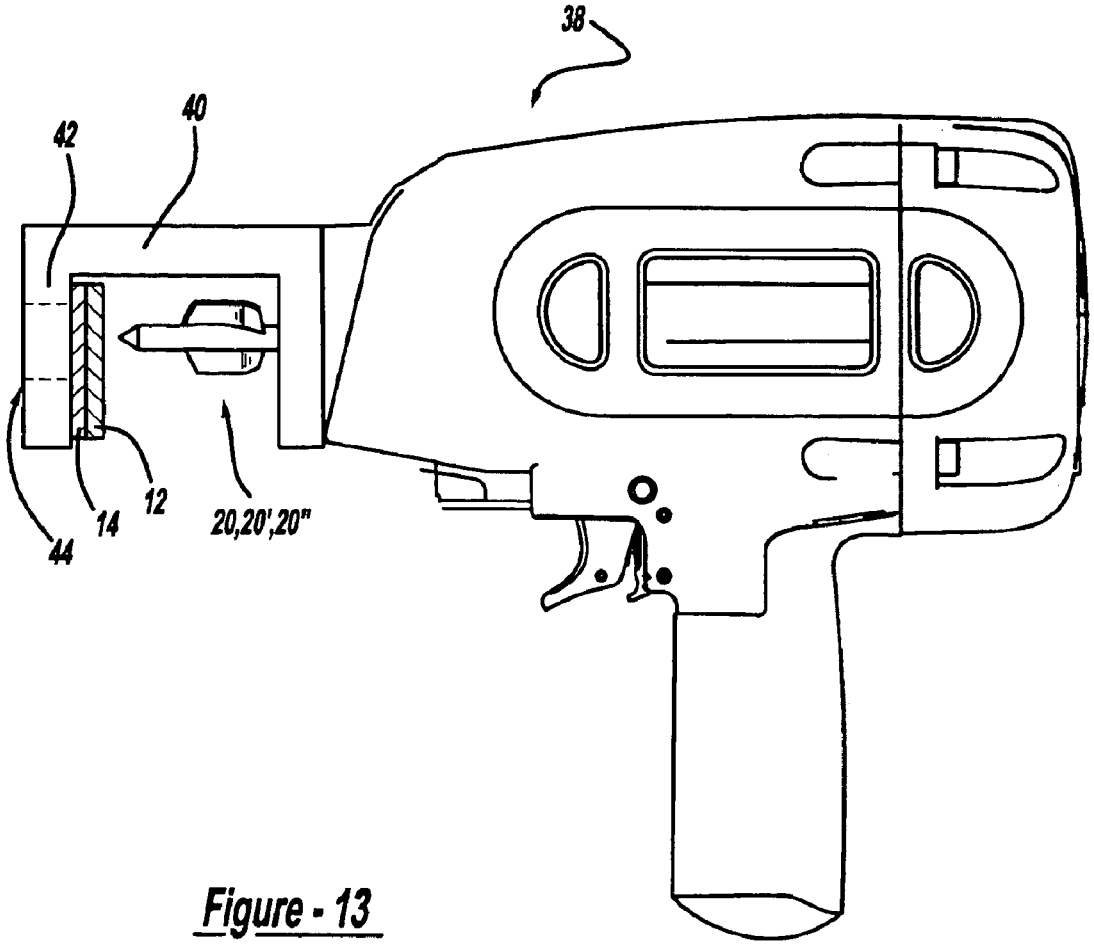
FIG. 13 is an illustration of a powered driver device that can be used with the rotatable punch in accordance with the present invention.
Figure 14:
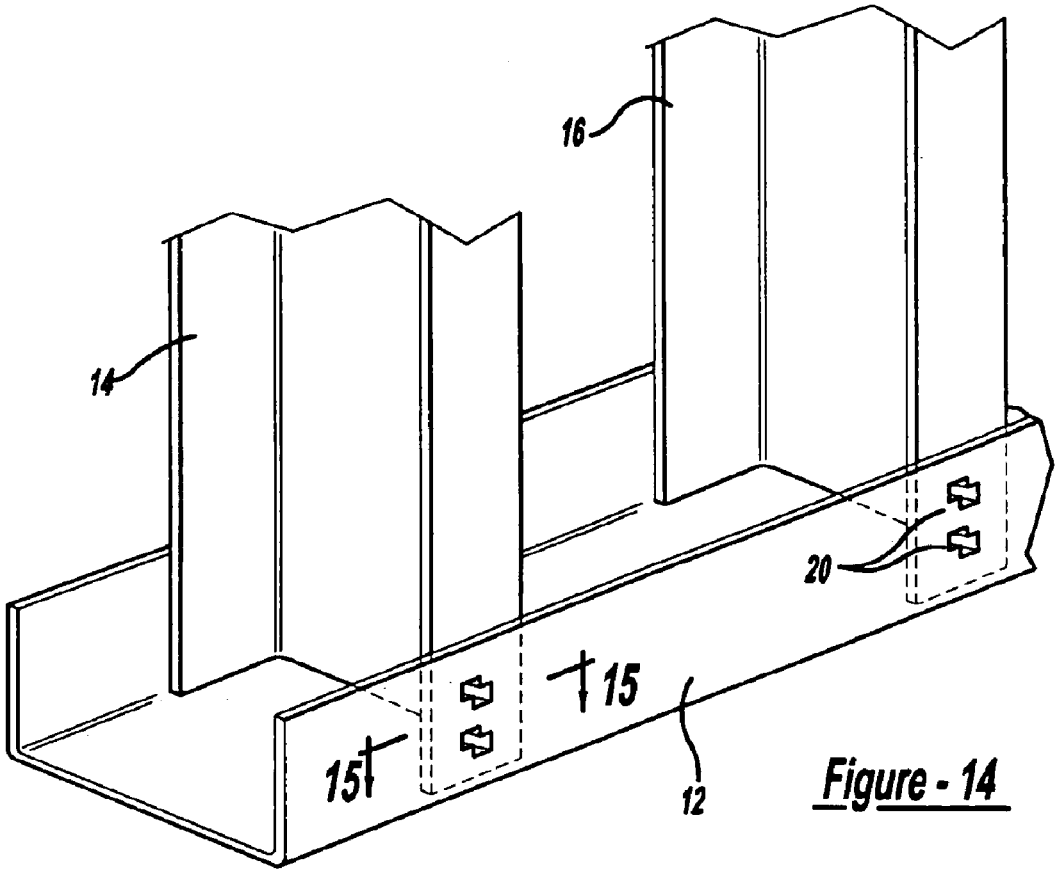
FIG. 14 is a fragmentary perspective view of a steel framing member having two additional steel framing members fastened thereto by an angular crimping technique in accordance with the present invention.

Preferably, a powered driver device 38, such as that shown in FIG. 13, is used to apply driving force F and rotational torque T to punch 20, 20' in a controlled and known manner. Powered driver device 38 can take a variety of forms, as will be apparent to one skilled in the art. Any powered driver devices capable of applying a driving force F and then applying a rotational torque T with a controlled amount of rotation of punch 20, 20' can be utilized to operate punch 20, 20' to crimp framing members 12 and 14 together.

When powered driver device 38 is utilized, second end of punch 20 can be integral to powered driver device 38 so that they form one device that is capable of crimping framing members 12 and 14 together. Depending upon the speed at which the device can drive punch 20, 20' through the framing members 12 and 14, a support for bottom surface 74 of framing member 14 may be needed. Preferably, the powered driver used is a rapid force driver device that can punch 20, 20' in excess of about 45 feet per second. When punch 20, 20' is driven in excess of about 45 feet per second, bottom surface 74 will not need to be supported. However, if the powered driver used drives pin 20, 20' at or below about 40 feet per second, bottom surface 74 may require support. To provide the support, powered driver 38 can have a C-shaped frame 40 with a backing surface 42 which has an opening 44 that allows a portion of punch 20, 20' to extend therethrough without obstructing operation of punch 20, 20'. Backing surface 42 is positioned on bottom surface 74 of framing member 14 to provide support for framing members 12 and 14 when punch 20, 20' is penetrating through framing members 12 and 14.

Figure 12:
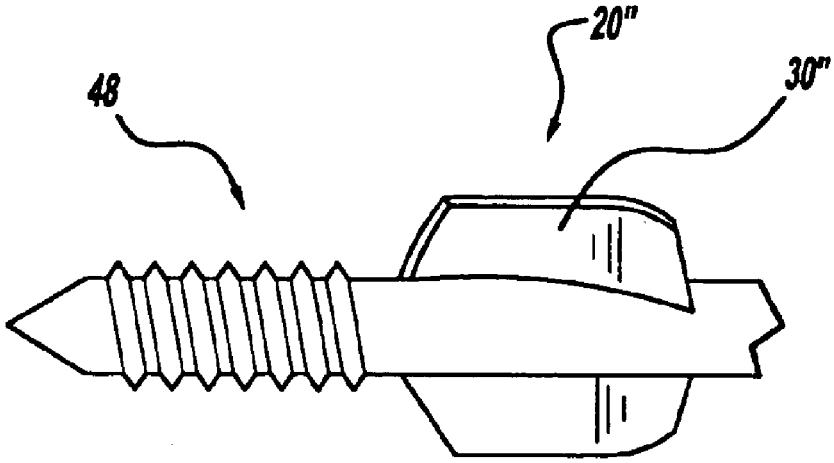
FIG. 12 is a side view of a third preferred embodiment of a rotatable punch in accordance with the present invention.

Referring now to FIG. 12, a third preferred embodiment of punch 20" is shown. Punch 20" is similar to punch 20 with the addition of a threaded portion 48 that extends along a portion of stem 26 between tip 28 and wings 30. Tip 28 pierces through framing members 12 and 14. When threaded portion 48 is adjacent top surface 70 of framing member 12, punch 20" is rotated. Engagement of threaded portion 48 with inner surfaces 72 pulls wings 30" into the framing members and causes a flaring or knurling of the material thereby fastening framing members 12 and 14 together. Punch 20" does not require the assistance of backing surface 42 to penetrate through and fasten framing members 12 and 14 together.

Punch 20, 20', 20" can be made from a variety of materials. Preferably, punch 20, 20', 20" is made from hardened steel. However, other materials, such as tungsten carbide or other strong material having similar characteristics to hardened steel that enable punch 20, 20', 20" to operate as described to fasten framing members 12 and 14 together can be utilized without departing from the scope of the present invention.

In a second aspect in accordance with the present invention, an angular piercing technique is used to fasten the steel framing members together by crimping the framing members together. The angular piercing technique uses one or more piercing members 120 which are driven through framing members at two locations and at opposing angles, as will be discussed in more detail below.

Piercing member 120 has axially opposite first and second ends 122 and 124. A stem 126 extends between first and second ends 122 and 124. The first end 122 has a tip 128 that is configured to allow piercing member 120 to penetrate through framing members in response to a driving force F applied to piercing member 120.

Figure 19:
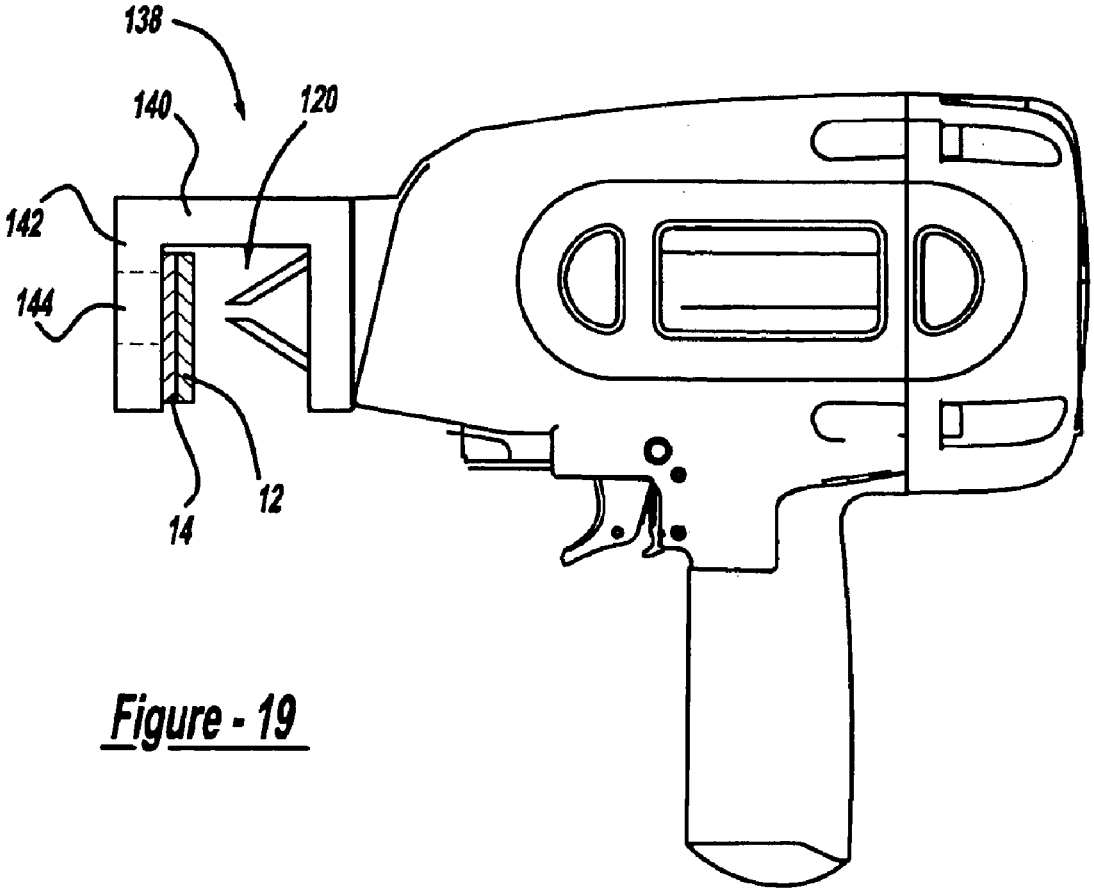
FIG. 19 is a side view of a powered driver device having two piercing members that can be used to crimp steel framing members together in accordance with the present invention.
Figure 20:
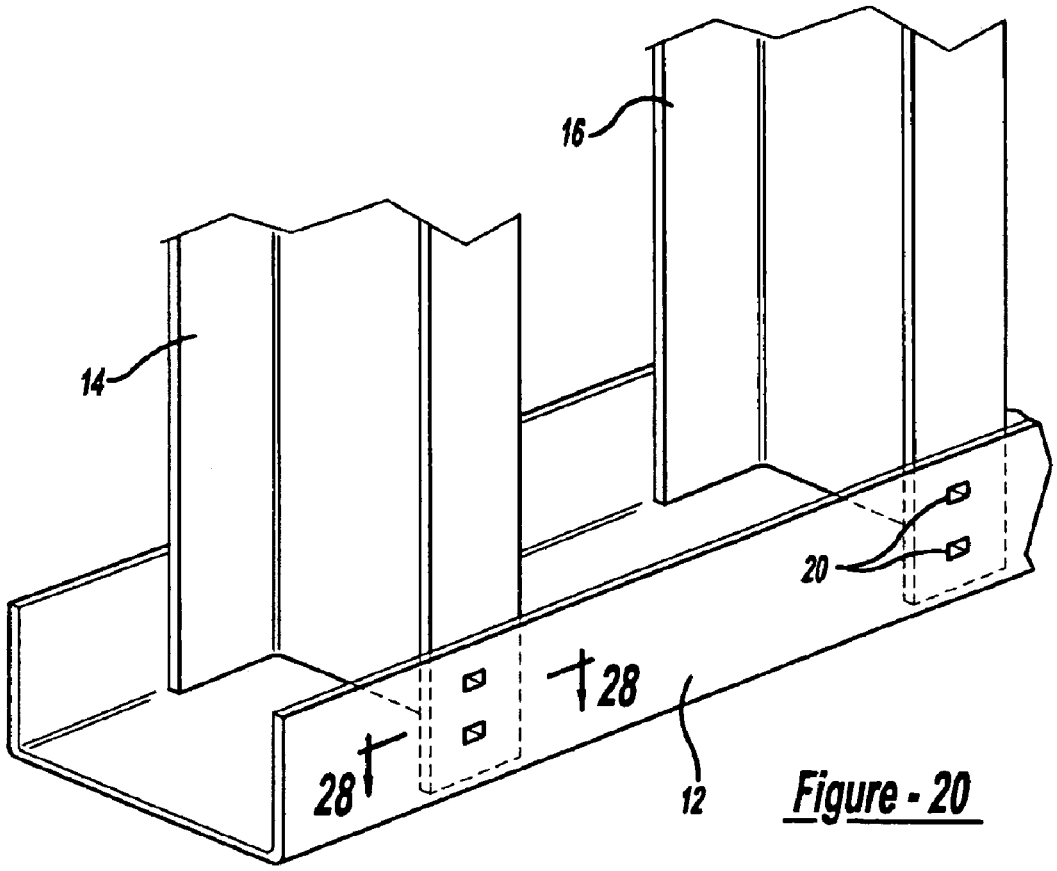
FIG. 20 is a fragmentary perspective view of a steel framing member having two additional steel framing members fastened thereto by a crimp joint formed by a fastenerless cinching tool in accordance with the present invention.
Figure 21:
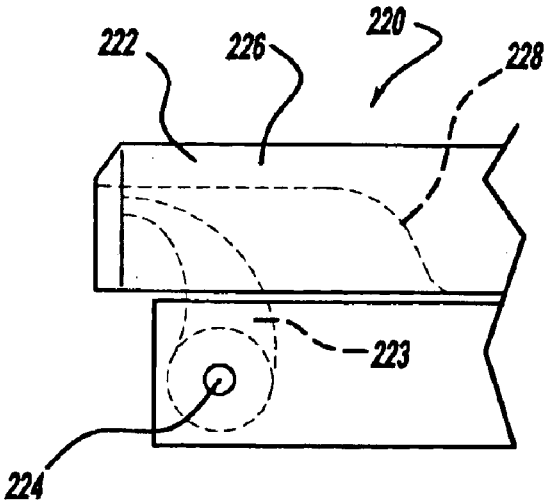
FIG. 21 is a side view of a first preferred embodiment of a fastenerless cinching tool in accordance with the present invention.
Figure 22:
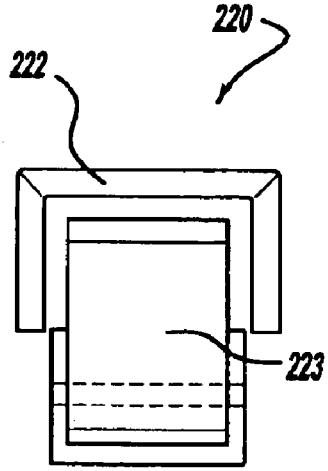
FIG. 22 is a front view of the first preferred embodiment of the fastenerless cinching tool in accordance with the present invention.
Figure 23:
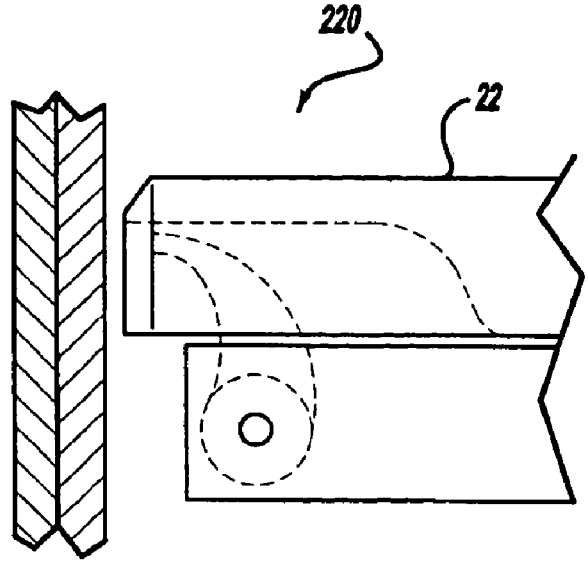
FIGS. 23–28 are cross-sectional views, taken along line 28—28 of FIG. 20, illustrating the operation of the first preferred embodiment of the fastenerless cinching tool in accordance with the present invention.
Figure 24:
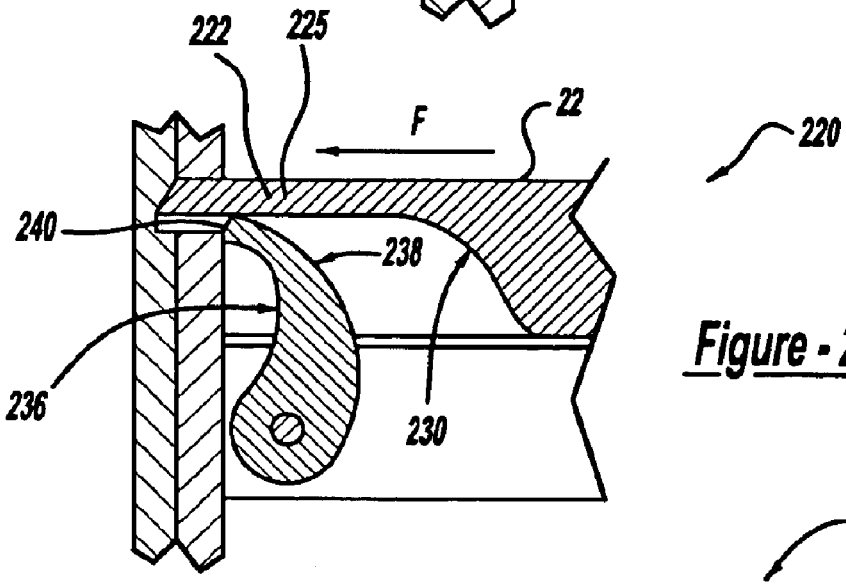
Figure 25:
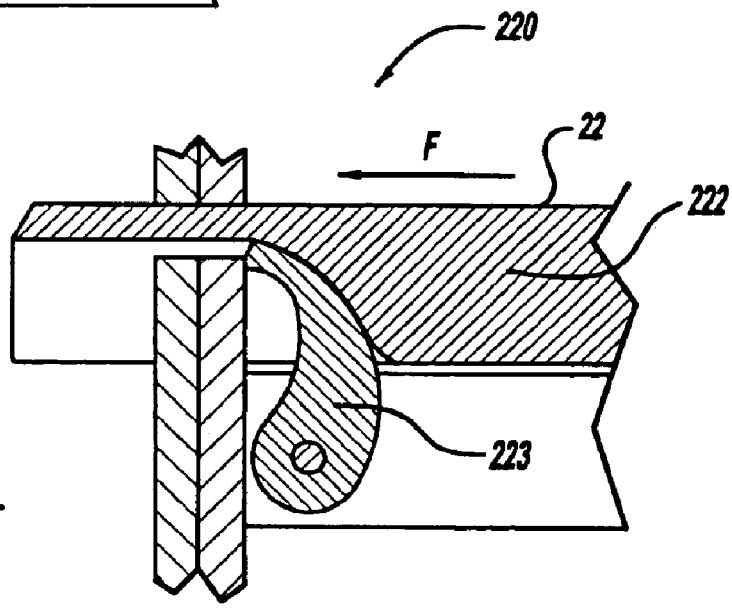
Figure 26:
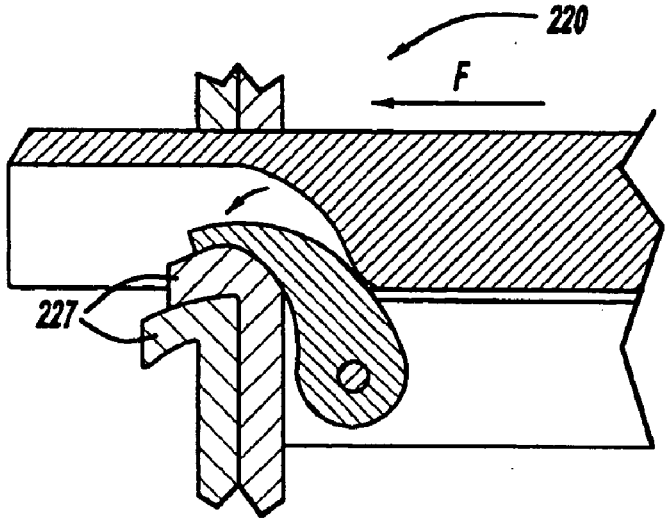
Figure 27:
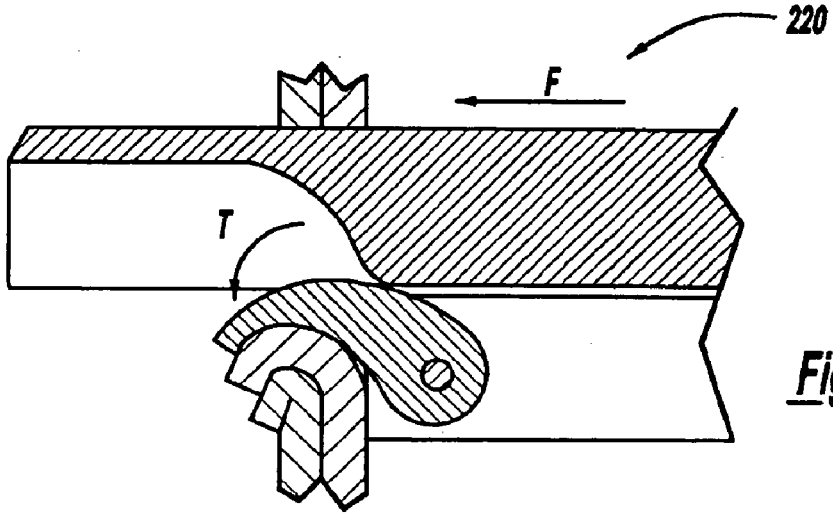
Figure 28:
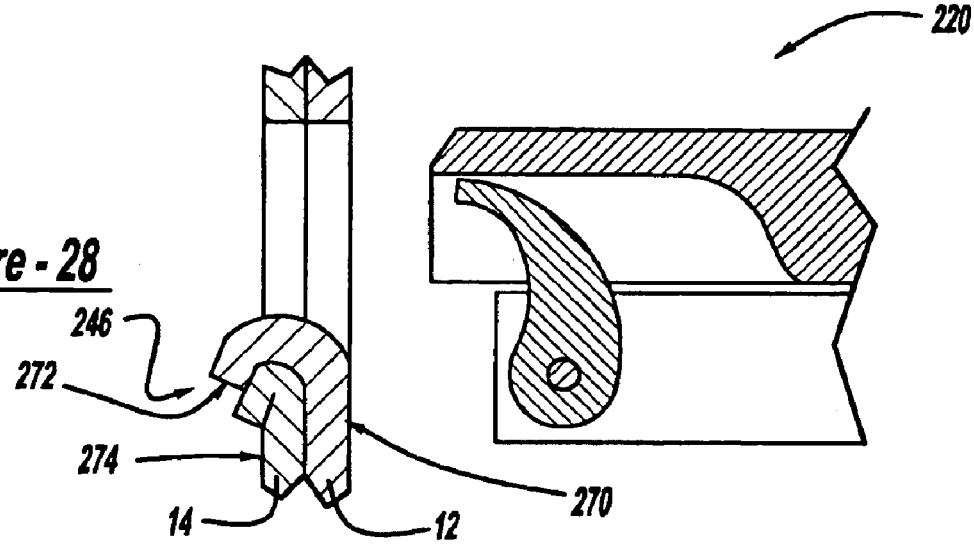
Figure 29:
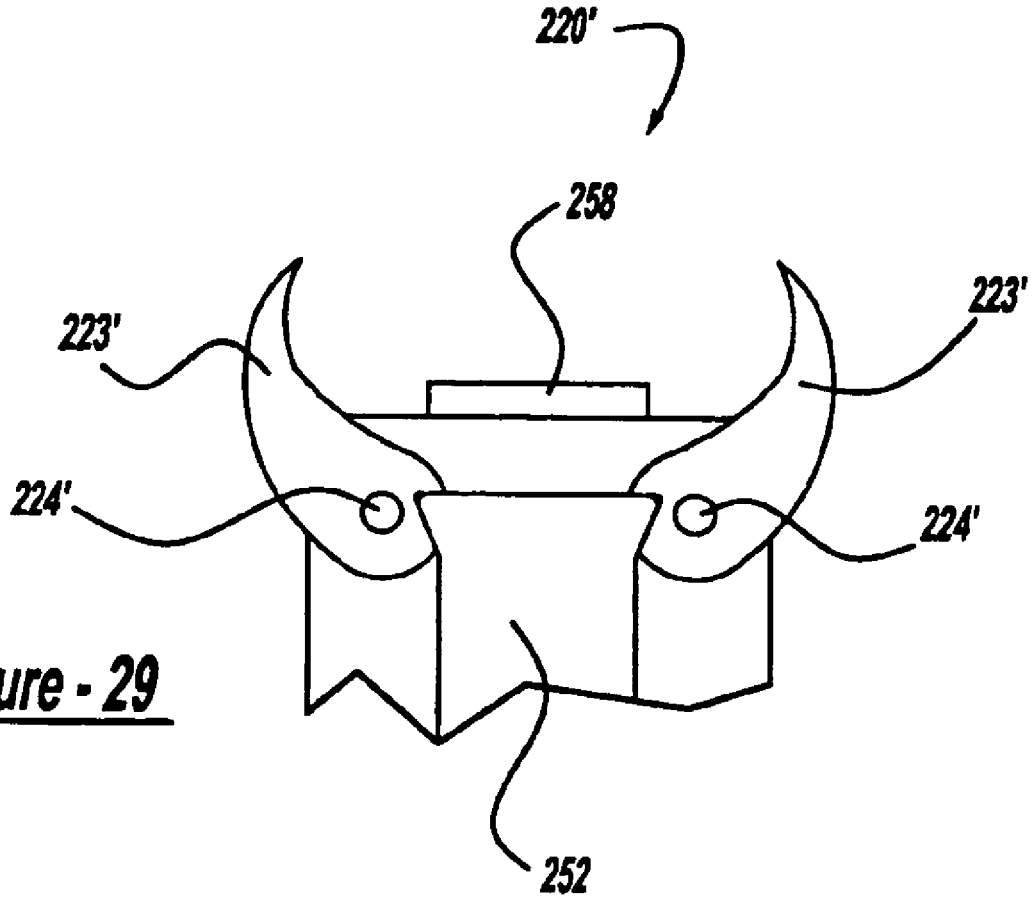
FIG. 29 is a side view of a second preferred embodiment of a fastenerless cinching tool in accordance with the present invention.
Figure 30:
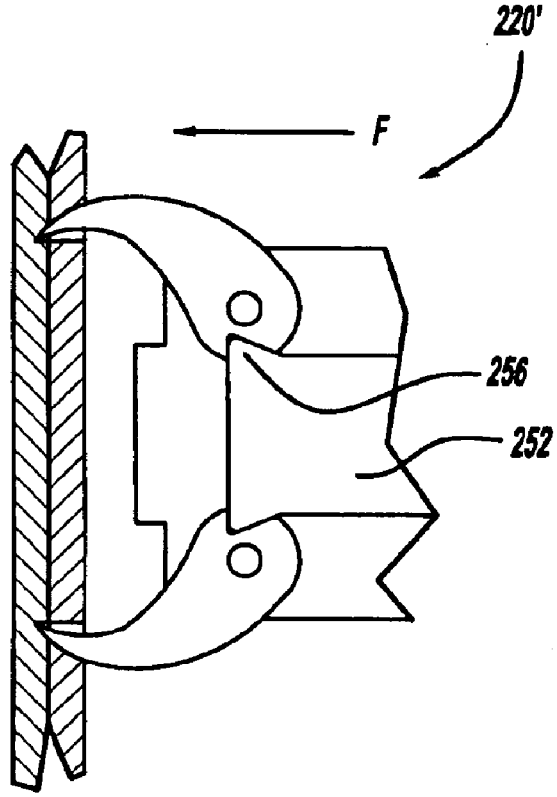
FIGS. 30–33 are cross-sectional views, taken along line 28—28 of FIG. 20, illustrating the operation of the second preferred embodiment of the fastenerless cinching tool in accordance with the present invention.
Figure 31:
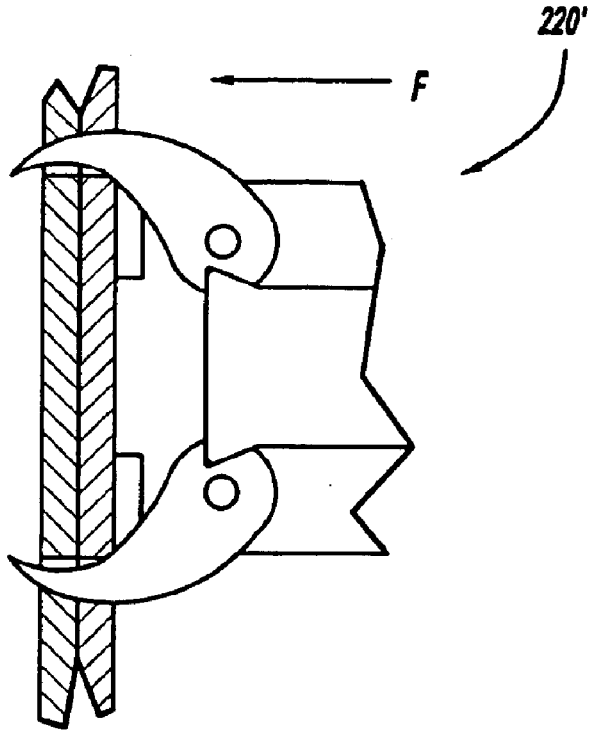
Figure 32:
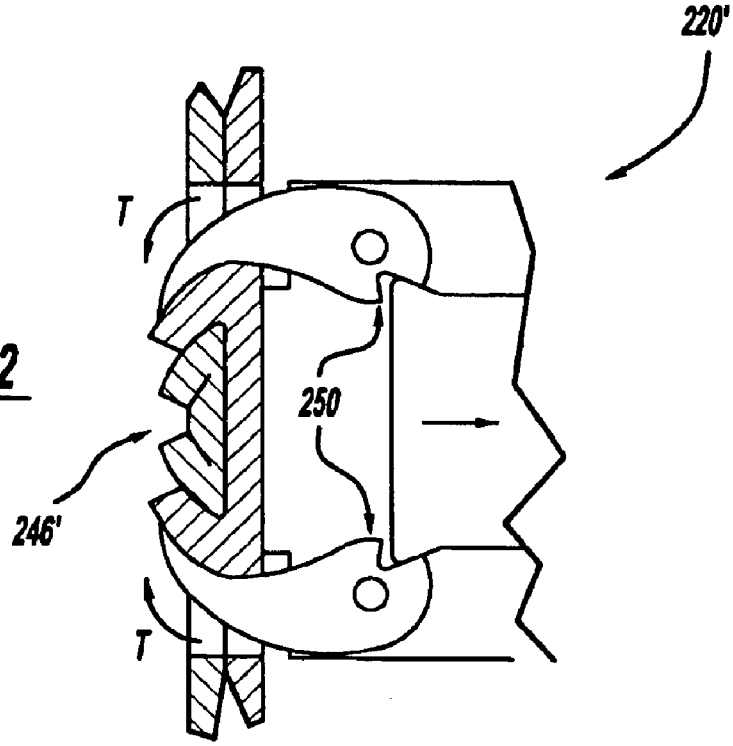
Figure 33:
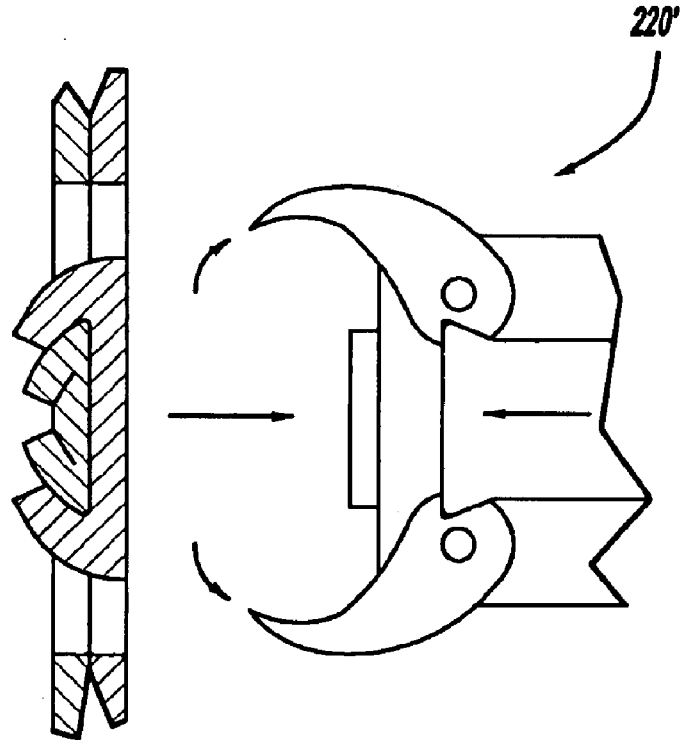

Tip 128 has an engaging surface 134 that engages with the framing members as piercing member 120 is driven therethrough. Engaging surface 134 is configured to deform the framing members as piercing member 120 is driven therethrough. Preferably, second end 124 of piercing member 120 is attached to a powered driver device 138, as shown in FIG. 19. Preferably, powered driving device 138 has two piercing members 120 that penetrate through the framing members concurrently.

When using a powered driver device, depending upon the speed at which the device can drive piercing member 120, a support for bottom surface 174 of framing member 14 may be needed. Preferably, the powered driver device used is a rapid force powered driver device that can drive piercing member 120 in excess of about 45 feet per second. When piercing member 120 is driven in excess of about 45 feet per second, bottom surface 174 will not need to be supported. However, if the powered driver device used drives piercing member 120 at or below about 40 feet per second, bottom surface 174 may require support. To provide the support, powered driving device 138 can have a C-shaped frame 140 with a backing surface 142. Backing surface 142 of frame 140 supports bottom surface 174 of framing member 14 when piercing members 120 are penetrating therethrough. Backing surface 142 has an opening 144 that is configured to allow piercing members 120 to pass therethrough as piercing members 120 penetrate through the framing members 12 and 14. Powered driving device 138 is configured to drive piercing members 120 along axes 145 through framing members 12 and 14 in different directions and at an angle relative to top surface 170 of framing member 12.

Figure 15:
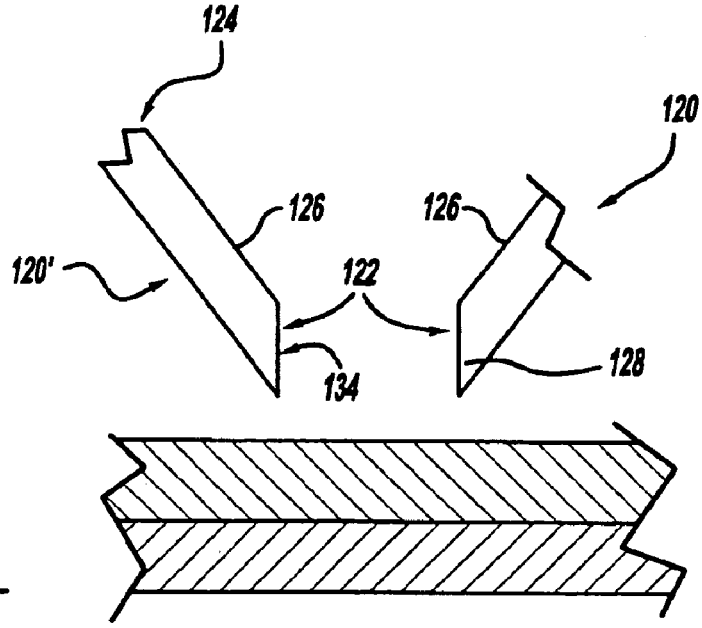
FIG. 15 is a cross-sectional view, taken along line 15—15 of FIG. 14, illustrating the opposing angles of two piercing members in relation to the two steel framing members in accordance with the present invention.
Figure 18:
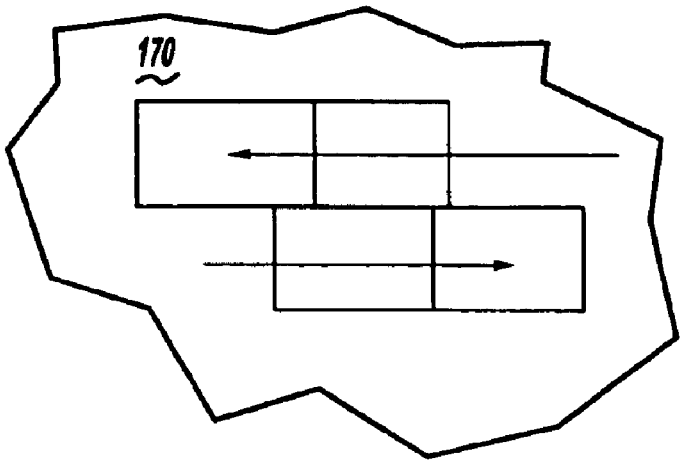
FIG. 18 is a top view illustrating the opposing entry angles and directions of the two piercing members in accordance with the present invention.

Alternatively, piercing member 120 can be in the form of a piercing nail 120', as shown in FIG. 15. Piercing nail 120' operates the same as piercing members 120 with the exception that piercing nail 120'will remain positioned in framing members 12 and 14 after crimping them together whereas piercing members 120 are removed. Piercing member 120' as will be recognized by one skilled in the art can be driven by an air nailer or other well known device that may be adapted to drive the piercing nails 120' into the framing members.

In operation, tips 128 of piercing members 120 are positioned adjacent two or more steel framing members 12 and 14. Powered driving device 138 applies an driving force F to piercing members 120, which are facing generally opposite directions and angled relative to top surface 170 of framing member 12 such that piercing members 120 are not perpendicular to top surface 170. Driving force F is applied to piercing members 120 which causes tip 128 and stem 126 to penetrate through framing members 12 and 14 along axes 145. Engaging surfaces 134 deform framing members 12 and 14 proximate piercing member 120 causing them to fold back or curl upon themselves and thereby crimp together. Concurrently or consecutively, a second piercing member 120 is driven by driving force F in a direction generally opposite the first piercing member 120 and also causes tip 128 and stem 126 to penetrate through framing members 12 and 14. Engaging surface 134 deforms framing members 12 and 14 generally in an opposite direction and causes the framing members 12 and 14 to curl onto or bend onto themselves thereby crimping framing members 12 and 14 together. The piercing members 120 are then backed out of the framing members 12 and 14 leaving the crimp joints which fasten framing members 12 and 14 together. The opposing nature of the direction in which the piercing members 120 are driven and the framing members 12 and 14 are deformed lock the framing members 12 and 14 together and provides a secure crimped joint that securely fastens framing members 12 and 14 together and meets the above stated requirements. The angle at which piercing members 120 penetrate through framing members 12 and 14 relative the top surface 170 effects the amount of deformation or crimping that occurs between framing members 12 and 14.

When piercing nail 120' is used instead of piercing members 120, the same procedure is followed with an exception that piercing nails 120' remain in framing members 12 an 14 whereas piercing members 120 are removed. Piercing nails 120' form part of the joint that crimps framing members 12 and 14 together.

Piercing members 120, 120', can be made from a variety of materials. Preferably, piercing members 120, 120' are made from hardened steel. However, other materials, such as tungsten carbide or other strong material having similar characteristics to hardened steel that enable piercing members 120, 120' to operate as described to fasten framing members 12 and 14 together can be utilized without departing from the scope of the present invention.

In a third aspect in accordance with the present invention, a fastenerless cinching tool 220 is used to form a crimp joint to join together two or more framing members. In a first preferred embodiment, as shown in FIGS. 21-28, cinching tool 220 has a piercing member 222 that is capable of movement to pierce framing members 12 and 14, as will be described in more detail below. Cinching tool 220 has a crimping finger 223 that rotates about a pivot 224 to crimp framing members 12 and 14 together, as will be described in more detail below. A first portion 225 of piercing member 222 is in the form of a U-shaped channel and has a leading edge 226 that is configured to facilitate piercing of the framing members and formation of a flap 227 in the framing members. It should be understood, however, first portion 225 can have a shape other than U-shaped and still be within the scope of the present invention. Flap 227 is U-shaped due to the shape of first portion 225 of piercing member 222. A second portion 228 of piercing member 222 is configured to cause rotation of crimping finger 223 in response to movement of piercing member 222. Specifically, axial movement of piercing member 222 relative to crimping finger 223 is translated into rotational movement of crimping finger 223 about pivot 224. To facilitate the translation of movement of piercing member 222 to rotational movement of crimping finger 223, second portion 228 has a curved engaging surface 230. The engaging surface 230 pushes on crimping finger 223 which results in rotational movement of crimping finger 223 about pivot 224.

Crimping finger 223 has opposite first and second surfaces 236 and 238 and a leading edge 240 extending therebetween. Leading edge 240 and first surface 236 engage with flap 227 to form a crimp joint 246 between the framing members, as will be described in more detail below. First surface 236 is preferably curved or concave to facilitate the bending and/or deforming of the framing members when forming crimp joint 246. Second surface 238 of crimping finger 223 is preferably convex and generally complementary to engaging surface 230 of piercing member 222. The convex nature of second surface 238 facilitates the translation of movement of piercing member 222 into rotational movement of crimping finger 223 about pivot 224. Crimping finger 223 has a spring (not shown) that resists rotation of crimping finger 223 about pivot 224 in response to movement of piercing member 222 toward the framing members. The spring acts to bias or return crimping finger 223 back to its original or noncrimping state when piercing member 222 is moved away from the framing members.

In operation cinching tool 222 is positioned with leading edge 226 of piercing member 222 adjacent a top surface 270 of two or more adjacent framing members, such as framing members 12 and 14. A driving force F is applied to piercing member 222 which causes piercing member 222 to move toward framing members 12 and 14. In response to driving force F and movement of piercing member 222, leading edge 226 and first portion 225 pierce framing members 12 and 14 and form flap 227. When first portion 225 has passed through framing members 12 and 14 a predetermined distance, second portion 228 of piercing member 222 engages with second surface 238 of crimping finger 223. Continued movement of piercing member 222 toward framing members 12 and 14 causes engaging surface 230 of piercing member 222 to push on second surface 238 of crimping finger 223 so that crimping finger 223 begins to rotate about pivot 224 toward flap 227. The contact between engaging surface 230 of piercing member 222 and second surface 238 of crimping finger 223 translates driving force F into a rotational torque T which causes crimping finger 223 to rotate about pivot 224. Rotation of crimping finger 223 toward flap 227 causes leading edge 240 and first surface 236 to engage with top surface 270 of framing member 12 and begin to deform flap 227 so that framing members 12 and 14 bend or fold over upon themselves. As piercing member 222 continues to move toward framing members 12 and 14, flap 227 is deformed sufficiently to form crimp joint 246 between framing members 12 and 14. Driving force F is then removed and piercing member 222 is moved relative to crimping finger 223 away from framing member 12 and 14. Movement of piercing member 222 away from framing members 12 and 14 disengages engaging surface 230 of piercing member 222 from second surface 238 of crimping finger 223 which allows crimping finger 223 to return to its normal state due to the spring. Cinching tool 220 can then be moved away from framing member 12 and 14. The crimp joint 246 formed thereby fastens framing members 12 and 14 together and satisfies the above-stated requirements.

Referring now to FIGS. 29–33, a second preferred embodiment of cinching tool 220' is shown. Cinching tool 220' has a pair of crimping fingers 223' that each rotate about separate pivots 224'. Each crimping finger 223' has a leading edge 240' that is configured to pierce framing members 12 and 14. Each crimping finger 223' has a recess 250 that is configured to engage with a ram 252 whose movement is translated into rotational movement of crimping fingers 223' about pivot 224', as will be described in more detail below. Each crimping finger 223' has first and second surfaces 236' and 238' that engage with framing members 12 and 14 during the formation of a crimp joint 246'. First surface 236' is concave to facilitate the deformation of framing members 12 and 14 when forming crimp joint 246'. Second surfaces 238' of crimping finger 223' are convex to facilitate piercing through framing members 12 and 14.

Ram 252 is capable of movement relative to crimping fingers 223' to cause crimping fingers 223' to rotate about pivot 224' and form crimp joint 246'. An engaging portion 254 of ram 252 flares outwardly as engaging portion 254 extends towards an end 256 of ram 252. Engaging portion 254 is complementary to recesses 250 in crimping fingers 223' to facilitate the translation of movement of ram 252 to rotational movement of crimping fingers 223' about pivot 224'.

Cinching tool 220' has a stop 258 that is configured to engage with top surface 270 of framing member 12 and control the axial penetration of crimping fingers 223' through framing members 12 and 14. That is, stop 258 is dimensioned so that crimping fingers 223' extend through bottom surface 274 of framing member 14 a desired distance that accommodates a thickness of framing members 12 and 14 and is favorable to forming crimp joint 246'.

In operation, cinching tool 220' is positioned with leading edges 240' of crimping fingers 223' adjacent top surface 270 of framing member 12. Driving force F is applied to cinching tool 220' which causing crimping fingers 223' to pierce through framing members 12 and 14. When stop 258 engages with top surface 70 of framing member 12, movement of cinching tool 220' toward framing members 12 and 14 is ceased. Ram 252 is then moved relative to crimping fingers 223' away from framing members 12 and 14. Movement of ram 252 away from framing members 12 and 14 causes engaging portion 254 to pull on recesses 250 and crimping fingers 223' to rotate about pivot 224' toward one another. That is, axial movement of ram 252 away from framing members 12 and 14 is translated into a rotational torque T that causes crimping fingers 223' to rotate toward one another about pivots 224'. Ram 252 continues to move away from framing members 12 and 14 until crimping fingers 223' have rotated sufficiently to deform framing members 12 and 14 to form crimp joint 246'. Ram 252 is then moved toward framing members 12 and 14 which causes crimping fingers 223' to rotate away from one another and disengage from crimp joint 246'. When crimping fingers 223' have been sufficiently rotated away from one another, cinching tool 220' can be moved away from framing members 12 and 14. The crimp joint 246' formed thereby fastens framing members 12 and 14 together and meets the requirements stated above.

Crimping fingers 223 can be made from a variety of materials. Preferably, crimping fingers 223 are made from hardened steel. However, other materials, such as tungsten carbide or other strong material having similar characteristics to hardened steel that enable crimping fingers 223 to operate as described to fasten framing members 12 and 14 together can be utilized without departing from the scope of the present invention.

In a variation on cinching tool 220', crimping fingers 223' can be arranged on cinching tool 220' so that they rotate in an opposite direction to crimp framing members 12 and 14 together. The fingers 223' are positioned so that the tips on fingers 223' are adjacent and pierce a single opening through framing members 12 and 14. The fingers 223' then rotate away from one another and form two crimp joints.

The description of the invention is merely exemplary in nature and, thus, variations that do not depart from the gist of the invention are intended to be within the scope of the invention. Such variations are not to be regarded as a departure form the spirit of the invention.

What is claimed is:

1. A tool for fastening framing members together comprising:

a crimping member having opposite first and second surfaces and operable to engage a flap in framing members, rotate about a pivot to deform said flap with said first surface and form a crimp joint that fastens said framing members together; and a piercing member capable of movement relative to said crimping member and having a first portion configured to pierce said framing members and a second portion configured to rotate said crimping member, said piercing member being operable to move relative to said crimping member, pierce said framing members with said first portion to form said flap, rotate said crimping member with said second portion to form said crimp joint, and withdraw from said framing members.

2. The tool of claim 1, wherein said first portion has a generally U-shaped cross section and forms a generally U-shaped flap in said framing members.

3. The tool of claim 1, wherein said second portion of said piercing member is curved to facilitate rotation of said crimping member about said pivot in response to movement of said second portion.

4. The tool of claim 1, wherein said second surface of said crimping member is curved to facilitate rotation of said crimping member about said pivot in response to movement of said second portion of said piercing member.

5. The tool of claim 1, wherein said first surface of said crimping member is curved to facilitate deforming said flap.

6. The tool of claim 1, wherein said crimping member is spring loaded to disengage from said flap as said piercing member is removed from said framing members.

7. A tool for fastening framing members together comprising:

at least two crimping members each having a tip configured to pierce framing members in response to movement of said crimping members and each being operable to pierce a same surface of said framing members, rotate about separate pivots to deform a portion of said framing members and form a crimp joint that fastens said framing members together; and a ram capable of movement relative to said crimping members and having an engaging portion configured to rotate said crimping members, said ram member being operable to move relative to said crimping members and rotate said crimping members about said separate pivots with said engaging portion to form said crimp joint.

8. The tool of claim 7, wherein said engaging portion of said ram flares outwardly.

9. The tool of claim 8, wherein said crimping members each have a recesses complementary to said outwardly flaring engaging portion of said ram.

10. The tool of claim 7, wherein each crimping member has a curved surface that engages with and deforms said portion of said framing members.

11. The tool of claim 7, further comprising a stop that engages with said framing members and limits movement of said crimping members toward said framing members.

12. The tool of claim 7, wherein movement of said ram relative to said crimping members away from said framing members causes said crimping members to rotate toward said framing members and movement of said ram relative to said crimping members toward said framing members causes said crimping members to rotate away from said framing members.

13. The tool of claim 7, wherein said crimping members pierce through said framing members at a common location and rotate away from one another when forming said crimp joint.

14. The tool of claim 7, wherein said same surface of said framing members is a planar surface.

15. The tool of claim 7, wherein movement of said ram is linear movement and said engaging portion of said ram directly engages with said crimping members.

16. A tool for fastening framing members together, the tool comprising:

at least two crimping members each having a tip operable to pierce framing members and each being operable to pierce said framing members, rotate about separate pivots to deform a portion of said framing members and form a crimp joint that fastens said framing members together; and a ram operable to rotate said crimping members, movement of said ram member away from said framing members causing said crimping members to rotate and form said crimp joint in said framing members.

17. The tool of claim 16, wherein said ram has an engaging portion that directly engages with said crimping members and causes rotation of said crimping members about said separate pivots.

18. The tool of claim 16, wherein said crimping members rotate toward one another when forming said crimp joint.

* * * * *